US011191398B2

(12) United States Patent
Warren

(10) Patent No.: US 11,191,398 B2
(45) Date of Patent: Dec. 7, 2021

(54) FRAGRANCE RELEASING TOILET PAPER ASSEMBLY

(71) Applicant: Sharon Warren, Missouri City, TX (US)

(72) Inventor: Sharon Warren, Missouri City, TX (US)

( * ) Notice: Subject to any disclaimer, the term of this patent is extended or adjusted under 35 U.S.C. 154(b) by 322 days.

(21) Appl. No.: 16/433,789

(22) Filed: Jun. 6, 2019

(65) Prior Publication Data

US 2020/0383531 A1 Dec. 10, 2020

(51) Int. Cl.
*A47K 10/38* (2006.01)

(52) U.S. Cl.
CPC ..... *A47K 10/38* (2013.01); *A47K 2010/389* (2013.01)

(58) Field of Classification Search
CPC .. A47K 10/16; A47K 10/38; A47K 2010/389; A47L 13/17; B65B 5/04; B65B 55/00; B65B 63/04; B65D 85/50; B65D 81/2007; B65D 85/70; A61L 9/01
See application file for complete search history.

(56) References Cited

U.S. PATENT DOCUMENTS

| | | | | |
|---|---|---|---|---|
| D260,193 | S | 8/1981 | Elchook, Jr. | |
| 5,115,915 | A * | 5/1992 | Harris | B65D 85/505 206/423 |
| 6,221,211 | B1 | 4/2001 | Hollenberg | |
| 6,425,530 | B1 | 7/2002 | Coakley | |
| 6,833,340 | B2 | 12/2004 | Lefenfeld | |
| 7,340,417 | B2 | 3/2008 | Kaufinan | |
| 10,138,447 | B2 * | 11/2018 | Mirajkar | B65D 1/02 |
| 10,912,429 | B2 * | 2/2021 | Moriwaki | A47K 10/16 |
| 2006/0006089 | A1 | 1/2006 | Arash | |
| 2007/0023564 | A1 * | 2/2007 | Platt | A47K 5/08 242/560.3 |
| 2007/0048474 | A1 * | 3/2007 | Butler, III | B65H 75/10 428/36.9 |
| 2007/0110963 | A1 | 5/2007 | Uehara | |
| 2013/0221146 | A1 * | 8/2013 | Cooper, I | B65H 16/005 242/160.4 |
| 2015/0272403 | A1 | 10/2015 | Silverman | |
| 2019/0110648 | A1 * | 4/2019 | Moriwaki | A47K 10/16 |

FOREIGN PATENT DOCUMENTS

| | | | | |
|---|---|---|---|---|
| JP | 2019208847 A | * 12/2019 | | A61L 9/12 |
| WO | WO-2018061330 A1 | * 4/2018 | | A47K 10/16 |

* cited by examiner

*Primary Examiner* — William A. Rivera

(57) ABSTRACT

A fragrance releasing toilet paper assembly for freshening air in a bathroom includes a roll of toilet paper, which in turn comprises a tube and tissue paper. A reservoir is coupled to an inner surface of the tube. The reservoir comprises an aroma compound and is configured to release the aroma compound into the tissue paper so that the aroma compound is gradually emitted from the tissue paper on the tube, therein providing a base level of air freshening. The aroma compound is rapidly emitted from the tissue paper upon contact of the tissue paper with water, therein providing an increased level of air freshening. The tube is configured to be rotated on a rod of a toilet paper holder so that a rate of emission of the aroma compound from the reservoir is increased, which also increases the level of air freshening.

12 Claims, 2 Drawing Sheets

FRAGRANCE RELEASING TOILET PAPER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relate to toilet paper assemblies and more particularly pertains to a new toilet paper assembly for freshening air in a bathroom.

BRIEF SUMMARY OF THE INVENTION

An embodiment of the disclosure meets the needs presented above by generally comprising a roll of toilet paper, which in turn comprises a tube and tissue paper. A reservoir is coupled to an inner surface of the tube. The reservoir comprises an aroma compound and is configured to release the aroma compound into the tissue paper so that the aroma compound is gradually emitted from the tissue paper on the tube, therein providing a base level of air freshening. The aroma compound is rapidly emitted from the tissue paper upon contact of the tissue paper with water, therein providing an increased level of air freshening. The tube is configured to be rotated on a rod of a toilet paper holder so that a rate of emission of the aroma compound from the reservoir is increased, which also increases the level of air freshening.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
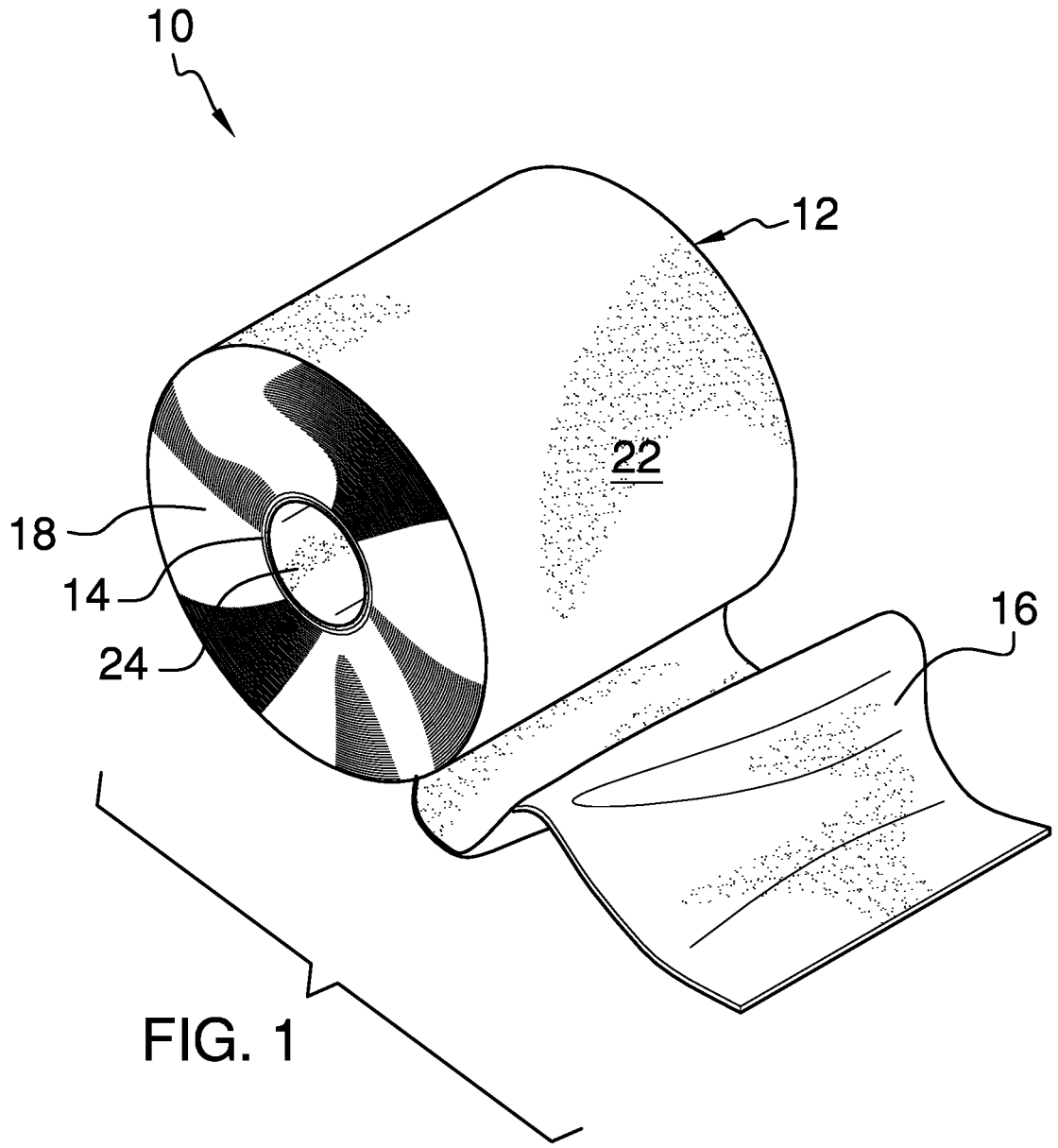
FIG. 1 is an isometric perspective view of a fragrance releasing toilet paper assembly according to an embodiment of the disclosure.
Figure 2:
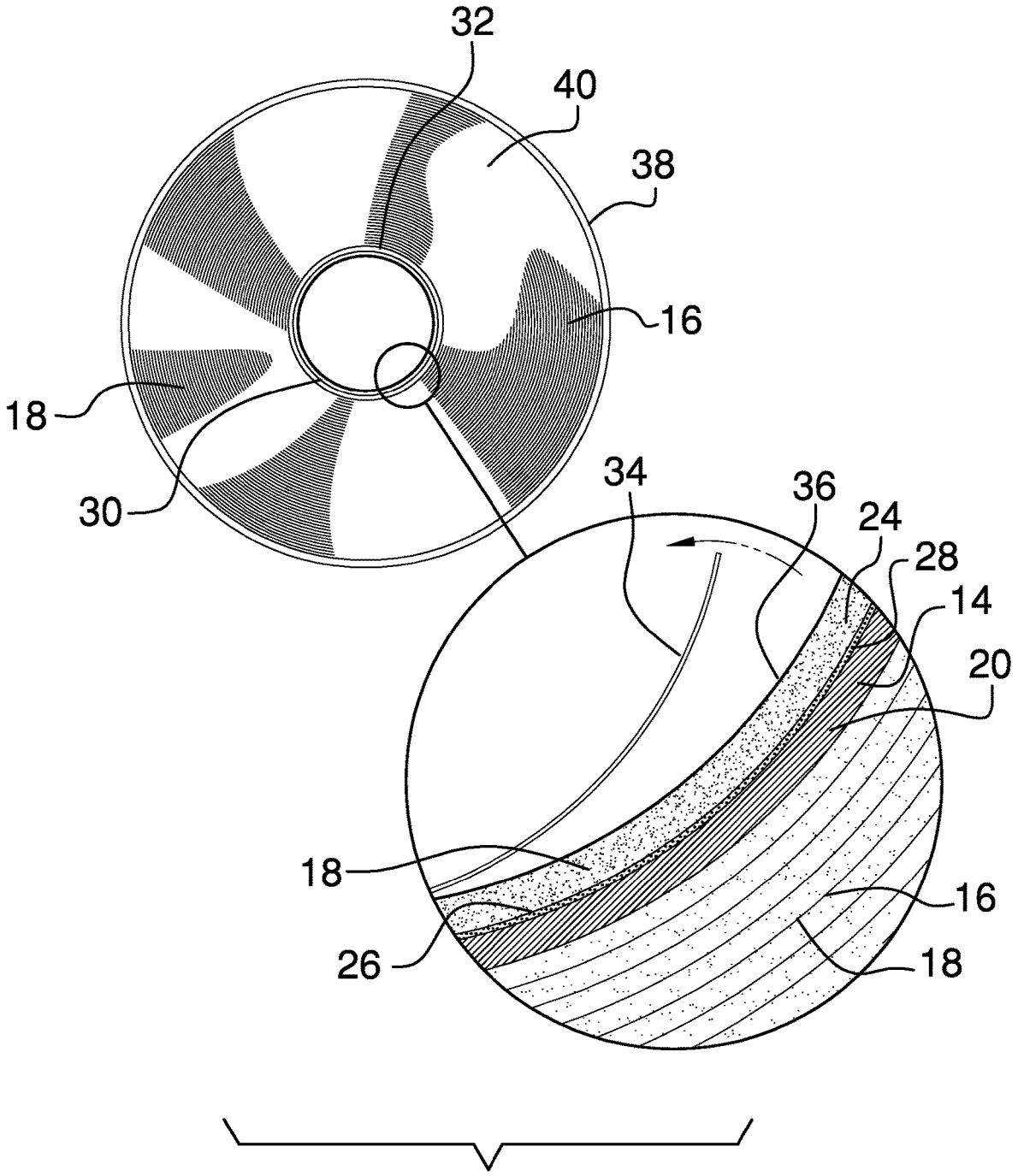
FIG. 2 is a detail view of an embodiment of the disclosure.

With reference now to the drawings, and in particular to FIGS. 1 and 2 thereof, a new toilet paper assembly embodying the principles and concepts of an embodiment of the disclosure and generally designated by the reference numeral 10 will be described.

As best illustrated in FIGS. 1 and 2, the fragrance releasing toilet paper assembly 10 generally comprises a roll of toilet paper 12, which in turn comprises a tube 14 and tissue paper 16. The tube 14 comprises paperboard so that tube 14 is configured to diffuse an aroma compound 18 through a wall 20 of the tube 14. The tissue paper 16 has a color 22. The tissue paper 16 is at least one of white colored, beige colored, pink colored, peach colored, teal colored, blue colored, black colored, yellow colored, purple colored, red colored, brown colored, orange colored, gold colored, grey colored, and green colored.

A reservoir 24 is coupled to an inner surface 26 of the tube 14. An adhesive 28 is coupled to and positioned between the reservoir 24 and the tube 14 so that the reservoir 24 is adhesively is coupled to the tube 14. The reservoir 24 comprises the aroma compound 18 and is configured to release the aroma compound 18 into the tissue paper 16 so that the aroma compound 18 is gradually emitted from the tissue paper 16 on the tube 14, therein providing a base level of air freshening. The aroma compound 18 is rapidly emitted from the tissue paper 16 upon contact of the tissue paper 16 with water, providing an increased level of air freshening. The tube 14 is configured to be rotated on a rod of a toilet paper holder so that a rate of emission of the aroma compound 18 from the reservoir 24 is increased, which also increases the level of air freshening.

The reservoir 24 comprises the aroma compound 18 impregnated into at least one of wax, wood, wood pulp, and plastic. The reservoir 24 extends substantially between opposing ends 30 of the tube 14. The reservoir 24 extends around an inner circumference 32 of the tube 14. A membrane 34 is removably coupled to an inner face 36 of the reservoir 24. The membrane 34 is configured to be selectively removed from the inner face 36 to permit volatilization of the aroma compound 18 from the inner face 36. A user may elect to keep the membrane 34 in place on the inner face 36 if the base level of air freshening is sufficient for their requirements, or to remove all or part of the membrane 34 to increase the level of air freshening.

The aroma compound 18 comprises at least one of lily fragrance, champagne fragrance, tasty fragrance, lagoon fragrance, pacific fragrance, onyx fragrance, canary lemon fragrance, lavender fragrance, spice fragrance, chocolate fragrance, pumpkin fragrance, cashmere fragrance, pewter fragrance, and ivy fragrance so that the aroma compound 18 is selectively associable to a color 22 of the tissue paper 16.

The assembly 10 also comprises a shell 38 that defines an interior space 40. The roll of toilet paper 12 is positioned in the interior space 40. The shell 38 is substantially impermeable to the aroma compound 18 so that the shell 38 is positioned to retain the aroma compound 18 within the interior space 40, wherein the tissue paper 16 is impregnated with the aroma compound 18. The shell 38 comprises plastic so that the shell 38 is removable from the roll of toilet paper 12 by tearing.

In use, the shell 38 is removed from the roll of toilet paper 12 by tearing. If desired, the membrane 34 is removed from the inner face 36 of the reservoir 24 and the roll of toilet paper 12 is positioned on the rod of the toilet paper holder. The tissue paper 16, which is impregnated with the aroma compound 18, gradually emits the aroma compound 18 to provide the base level of air freshening. The aroma compound 18 also is rapidly emitted from the tissue paper 16 upon contact of the tissue paper 16 with the water in a bowl of a toilet, thereby providing the increased level of air freshening when the toilet is used. Additionally, as the tube 14 is rotated on the rod of the toilet paper holder, the rate of emission of the aroma compound 18 from the reservoir 24 is increased, which increases the level of air freshening.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fragrance releasing toilet paper assembly comprising:

a roll of toilet paper comprising a tube and tissue paper;

a reservoir coupled to an inner surface of the tube, the reservoir comprising an aroma compound wherein the reservoir is configured for releasing of the aroma compound into the tissue paper such that the aroma compound is gradually emitted from the tissue paper on the tube and wherein the aroma compound is rapidly emitted from the tissue paper upon contact of the tissue paper with water and wherein the tube is configured for rotating on a rod of a toilet paper holder such that a rate of emission of the aroma compound from the reservoir is increased; and a membrane, the membrane being removably coupled to an inner face of the reservoir wherein the membrane is configured for selectively removing from the inner face for permitting volatilization of the aroma compound from the inner face.

2. The assembly of claim 1, further including the tube comprising paperboard such that tube is configured for diffusion of the aroma compound through a wall of the tube.

3. The assembly of claim 1, further including the reservoir comprising the aroma compound impregnated into at least one of wax, wood, wood pulp, and plastic.

4. The assembly of claim 1, further including the reservoir extending substantially between opposing ends of the tube.

5. The assembly of claim 1, further including the reservoir extending around an inner circumference of the tube.

6. The assembly of claim 1, further including the tissue paper having a color.

7. The assembly of claim 6, further including the tissue paper being at least one of white colored, beige colored, pink colored, peach colored, teal colored, blue colored, black colored, yellow colored, purple colored, red colored, brown colored, orange colored, gold colored, grey colored, and green colored.

8. The assembly of claim 6, further including the aroma compound comprising at least one of lily fragrance, champagne fragrance, tasty fragrance, lagoon fragrance, pacific fragrance, onyx fragrance, canary lemon fragrance, lavender fragrance, spice fragrance, chocolate fragrance, pumpkin fragrance, cashmere fragrance, pewter fragrance, and ivy fragrance such that the aroma compound is selectively associable to a color of the tissue paper.

9. The assembly of claim 1, further including an adhesive coupled to and positioned between the reservoir and the tube such that the reservoir is adhesively coupled to the tube.

10. The assembly of claim 1, further including a shell defining an interior space, the roll of toilet paper being positioned in the interior space, the shell being substantially impermeable to the aroma compound such that the shell is positioned for retaining the aroma compound within the interior space such that the tissue paper is impregnated with the aroma compound.

11. The assembly of claim 10, further including the shell comprising plastic such that the shell is removable from the roll of toilet paper by tearing.

12. A fragrance releasing toilet paper assembly comprising:

a roll of toilet paper comprising a tube and tissue paper, the tube comprising paperboard such that tube is configured for diffusion of an aroma compound through a wall of the tube, the tissue paper having a color, the tissue paper being at least one of white colored, beige colored, pink colored, peach colored, teal colored, blue colored, black colored, yellow colored, purple colored, red colored, brown colored, orange colored, gold colored, grey colored, and green colored;

a reservoir coupled to an inner surface of the tube, the reservoir comprising the aroma compound wherein the reservoir is configured for releasing of the aroma compound into the tissue paper such that the aroma compound is gradually emitted from the tissue paper on the tube and wherein the aroma compound is rapidly emitted from the tissue paper upon contact of the tissue paper with water and wherein the tube is configured for rotating on a rod of a toilet paper holder such that a rate of emission of the aroma compound from the reservoir is increased, the reservoir comprising the aroma compound impregnated into at least one of wax, wood, wood pulp, and plastic, the reservoir extending substantially between opposing ends of the tube, the reservoir extending around an inner circumference of the tube, the aroma compound comprising at least one of lily fragrance, champagne fragrance, tasty fragrance, lagoon fragrance, pacific fragrance, onyx fragrance, canary lemon fragrance, lavender fragrance, spice fragrance, chocolate fragrance, pumpkin fragrance, cashmere fragrance, pewter fragrance, and ivy fragrance such that the aroma compound is selectively associable to a color of the tissue paper;

a membrane, the membrane being removably coupled to an inner face of the reservoir wherein the membrane is configured for selectively removing from the inner face for permitting volatilization of the aroma compound from the inner face;

an adhesive coupled to and positioned between the reservoir and the tube such that the reservoir is adhesively coupled to the tube; and a shell defining an interior space, the roll of toilet paper being positioned in the interior space, the shell being substantially impermeable to the aroma compound such that the shell is positioned for retaining the aroma compound within the interior space such that the tissue paper is impregnated with the aroma compound, the shell comprising plastic such that the shell is removable from the roll of toilet paper by tearing.

* * * * *